United States Patent [19]

Meier

[11] Patent Number: 4,953,443

[45] Date of Patent: Sep. 4, 1990

[54] DEVICE FOR THE ALIGNMENT OF AN AIMING AXIS BODY AT A TARGET POSITION

[75] Inventor: Ghert Meier, Stadel, Switzerland

[73] Assignee: Contraves AG, Zurich, Switzerland

[21] Appl. No.: 224,776

[22] PCT Filed: Nov. 2, 1987

[86] PCT No.: PCT/CH87/00149

§ 371 Date: Aug. 9, 1988

§ 102(e) Date: Aug. 9, 1988

[87] PCT Pub. No.: WO88/03637

PCT Pub. Date: May 19, 1988

[30] Foreign Application Priority Data

Nov. 3, 1986 [CH] Switzerland ..... 04347/86

[51] Int. Cl.[5] ..... F41G 3/02

[52] U.S. Cl. ..... 89/41.02; 89/41.19

[58] Field of Search ..... 89/41.01, 41.02, 41.12, 89/41.14, 41.19, 41.22, 40.02, 41.06, 41.07; 414/735; 901/15, 16

[56] References Cited

U.S. PATENT DOCUMENTS

| | | | |
|---|---|---|---|
| 1,353,499 | 9/1920 | Shearer | 89/37.16 |
| 2,762,265 | 9/1956 | Kuijvenhoven | 89/41.02 |
| 4,326,446 | 4/1982 | Magnuson | 89/34 |
| 4,367,532 | 1/1983 | Crum et al. | 901/15 |
| 4,606,695 | 8/1986 | Lenz | 414/735 |
| 4,714,004 | 12/1987 | Weinfurth | 89/40.02 |

FOREIGN PATENT DOCUMENTS

| | | | |
|---|---|---|---|
| 666317 | 10/1938 | Fed. Rep. of Germany | 89/41.01 |
| 2037819 | 2/1972 | Fed. Rep. of Germany | 89/41.02 |
| 3440041 | 5/1986 | Fed. Rep. of Germany | 89/41.12 |
| 831483 | 9/1938 | France | 89/41.01 |
| 948577 | 8/1949 | France | 89/41.02 |
| 154849 | 6/1956 | Sweden | 89/41.01 |
| 763082 | 9/1980 | U.S.S.R. | 414/735 |
| 548302 | 10/1942 | United Kingdom . | |

*Primary Examiner*—Stephen C. Bentley
*Assistant Examiner*—Stephen Johnson
*Attorney, Agent, or Firm*—Werner W. Kleeman

[57] ABSTRACT

The device comprises three rotational axes (7, 8, 9), whereby the first (7) and the second (8), counted from the axis of the target directed body, constitute a classical laying axis system, and a third rotational axis (9) between this laying axis system and the base support (5) of the device allows this laying system to pivot to a singularity axis, such that the device can carry out the laying movements thereof with adequate angular distance from its singularity, and whereby the first (7) and the third (9) rotational axis are spaced from one another by a distance (A), in order that there can be aimed without hindrance beyond a housing (10) in which the necessary auxiliary installations are accommodated.

5 Claims, 2 Drawing Sheets

DEVICE FOR THE ALIGNMENT OF AN AIMING AXIS BODY AT A TARGET POSITION

BACKGROUND OF THE INVENTION

The present invention relates to a device for the alignment of an aiming axis body, particularly a gun barrel, at a target position.

Generally speaking, the device for the alignment of an aiming axis body, particular a gun barrel, at a target position, is of the type comprising a base body which accommodates movable and immovable components of the device, and drive means for the alignment of the aiming axis body.

The classical field antiaircraft gun is provided with gunlaying means with two aiming coordinates and tracks a target position in that (a.) with a rotation about a first axis (azimuth axis) the layed aiming axis (the gun barrel) is pivoted into the plane which is determined by the target position and the first axis;

(b.) with the second axis (elevation axis) the aiming axis within this plane is layed on the target position.

Now if the target position is located on the first axis, the alignment of the plane, in which the aiming axis should be pivoted about the second axis, is indeterminate. The alignment (azimuth) can be optional. The direction of this axis thus represents a singularity of the aiming coordinates of the gun.

However, when the target position moves by close to this first axis (region round about the azimuth axis), then for a small travel of this target position there results a large change of direction of the above-discussed plane and thus for the gun on the ground; in other words, a large rotation of the laying means (on the ground) must be carried out about the azimuth axis in order to follow a small movement above in the region round about the azimuth axis. According to the velocity of the target position, this "large" rotation involves a corresponding rotational velocity and rotational acceleration of the weight masses of the gun on the ground. The faster and the closer the target position moves past the singularity axis, the higher are the dynamic requirements for the laying means. The provision of the required power has consequences on the resources to be provided (costs) and on the attainable accuracy.

A device, with which an attempt is made to deal with this problem, is described by way of example in the European Published Patent Application No. 72,699. This device partially fulfills the above-mentioned conditions, in which departing from the construction of classical gun installations, the singularity axis is arranged slightly inclined to the zenith-axis on a rotatable support and thus no longer at a right angle to the plane of the gun mount, such that during an azimuth rotation of this support the singularity axis moves about the zenith-axis on the jacket of a cone. This type of wobble movement of the singularity axis relative to the plane of the gun mount does improve the target tracking close to the zenith-axis, but this inclination is not sufficient to carry out in each angular range an optimum alignment of the aiming axis at a target.

Furthermore, the there proposed construction of the gun involves a difficult realization of the further requirements, which must be imposed on a gun suited for modern warfare. By way of example, the auxiliary apparatus must be arranged beneath or beside the illustrated gun mount, which either requires an undesired (very high) constructional height of the gun installation or results in a blind region in the operative range, which in most cases is likewise undesired (an exception are marine guns, in which the gun can be so to speak "extended" in the direction below deck).

In order to carry out a successful combatting of fast, maneuverable, small targets such as, for instance, guided missiles, a gun of the future must be able to fulfill the following conditions:

(a.) the gun must not be hindered by a stationary singularity axis, it must therefore be able to repel attacks from all directions (also out of the zenith);

(b.) the gun should only have to perform as small as possible rotational speeds and rotational accelerations at a given velocity of the attacking target;

(c.) the gun should have as small as possible inertias (loads), which have to be co-rotated during gun laying.

Apart from these most important requirements, still other conditions should be fulfilled for the useful operational combat as well as with regard to mobility and/or transporting capability, such conditions having a direct influence on the external configuration. These are, by way of example, transport profiles, simple erection at the location of employment, good accessibility for operational supply and maintenance of the installation and further conditions of this kind.

SUMMARY OF THE INVENTION

It is therefore an important object of the invention to fundamentally improve a device of the aforementioned type, so that with a relatively simple and low structural height a multifarious movement capability of the aiming axis body of the device (measuring device, gun barrel etc.) is ensured in optimum adaptation to the structural conditions. Furthermore, the device should render possible in a rapid and simple manner the alignment of an axis corresponding to the azimuth or singularity axis in directions in which the aiming axis can track a flying object at smallest loading of the drives of the device.

The object is achieved in accordance with the invention, in that the device comprises three rotational axes, whereby the first and the second, counted from the axis of the aiming axis body, constitute a classical aiming axis system, and a third rotational axis between this aiming axis system and the base support allows to pivot this aiming axis system, such that the device can carry out the laying movements thereof with adequate angular distance from its singularity, and that the first and the third rotational axis are in a spaced relationship to one another.

A preferred embodiment is characterized in that the device comprises two rotational axes, a first and a third, which can be set parallel to one another and are connected to form an axis system by a second rotational axis extending substantially perpendicular to the first and third rotational axes, whereby the two rotational axes, the first and the third are arranged at a distance to one another, whereby an axis corresponding with the singularity axis (which is the second axis of movement) can be pivoted about a large angular range and the distance is so chosen, that the hindrance of the alignment of the body of the aiming axis by the superstructures of the gun can be avoided.

From the above-described reasoning, the certainly unconventional and hardly obvious "mounting" of the classical azimuth axis (according to prior art standing vertically (as a singularity axis) or slightly inclined) on a "base axis" (which extends horizontally to the base) standing at a right angle thereto, is to be seen, by means of which, for example, a gun no longer has to carry out the well known rotation on the gun mount with co-movement of the superstructures, and whereby then also a totally different type of motion for the alignment of the body of the aiming axis is responsible. On the other hand, by applying the principle of the invention the singularity axis can now be pivoted through a very large range, which was hitherto not accessible. The auxiliary installations can be arranged as required by the corresponding choice of the distance of the first axis to the base axis (the third), without a blind region occurring between the target and the gun barrel (or measuring sensor). With the aid of this mentioned distance between the third axis and the system, the latter can be moved such that it can aim without hindrance beyond or across the housing of the gun in which the required auxiliary installations are accommodated and, moreover, the auxiliary installations need not be co-moved. Thus the abovementioned conditions placed upon a modern gun of the future are fulfilled.

BRIEF DESCRIPTION OF THE DRAWINGS

The invention will be better understood and objects other than those set forth above, will become apparent when consideration is given to the following detailed description thereof. Such description makes reference to the annexed drawing wherein throughout the various FIGURES of the drawings there have been generally used the same reference characters to denote the same or analogous components and wherein.

DETAILED DESCRIPTION OF THE PREFERRED EMBODIMENTS

Figure 1:
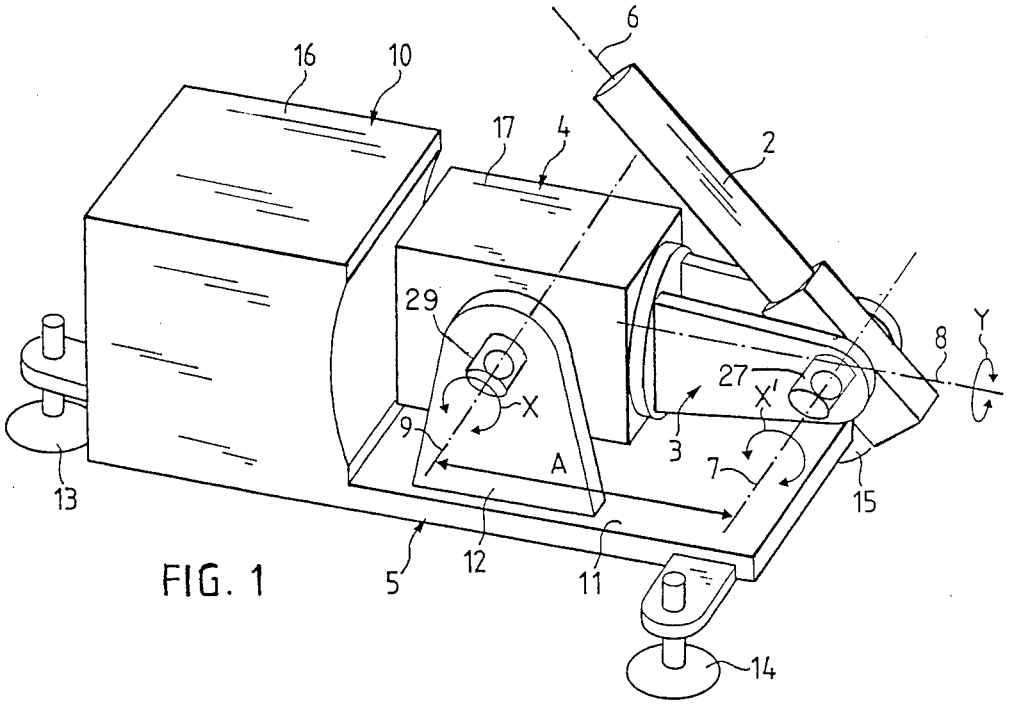
FIGS. 1 to 4 show schematically in perspective an exemplary embodiment of the inventive device in four positions of motion.

Describing now the drawings, it is to be understood that only enough of the construction of the device for the alignment of an aiming axis body has been shown as needed for those skilled in the art to readily understand the underlying principles and concepts of the present development, while simplifying the showing of the drawing. In the FIGURES of the drawing there has been specifically illustrated by way of example and not limitation a construction which results in optimum dynamic behavior and which is distinguished by the fact that the crossing point of first and second rotational axes, namely the first axis of movement 7 and the second axis of movement 8 constitutes an intersection point.

It is worthy of note that with the proposed axis arrangement a rotational axis 9 (base axis or third rotational axis) horizontally arranged on a base body 5 only requires a small rotary region of less than 90°, in order to render possible a setting for each target position (including the zenith range). This renders possible a relatively simple construction of the total device, inasmuch as the indispensable auxiliary aggregates in a housing 10 can be arranged right next to the base axis 9.

Figure 3:
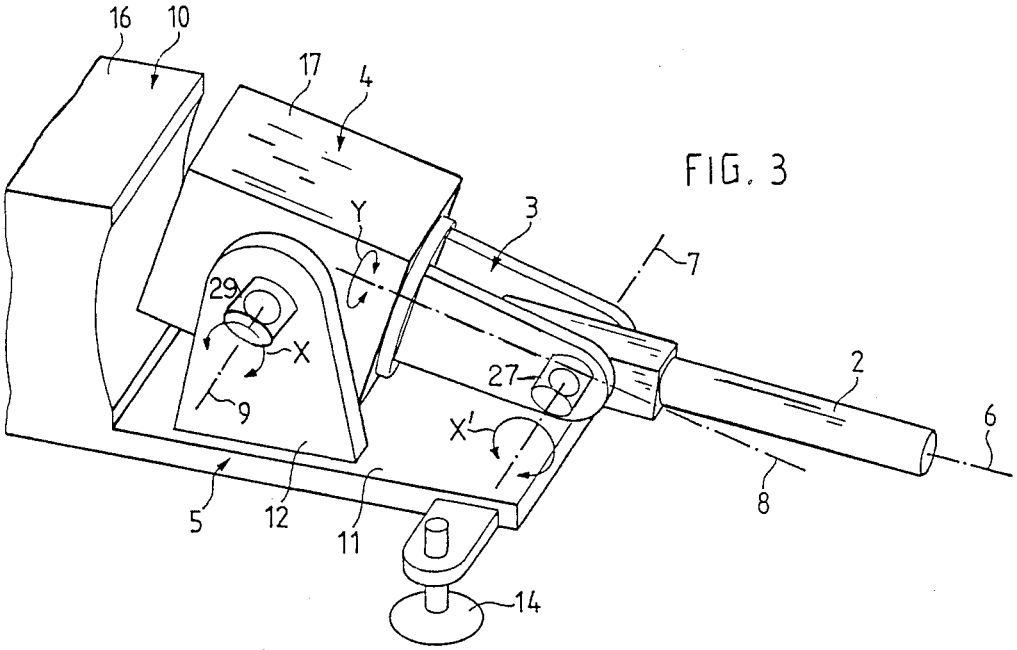
Figure 4:
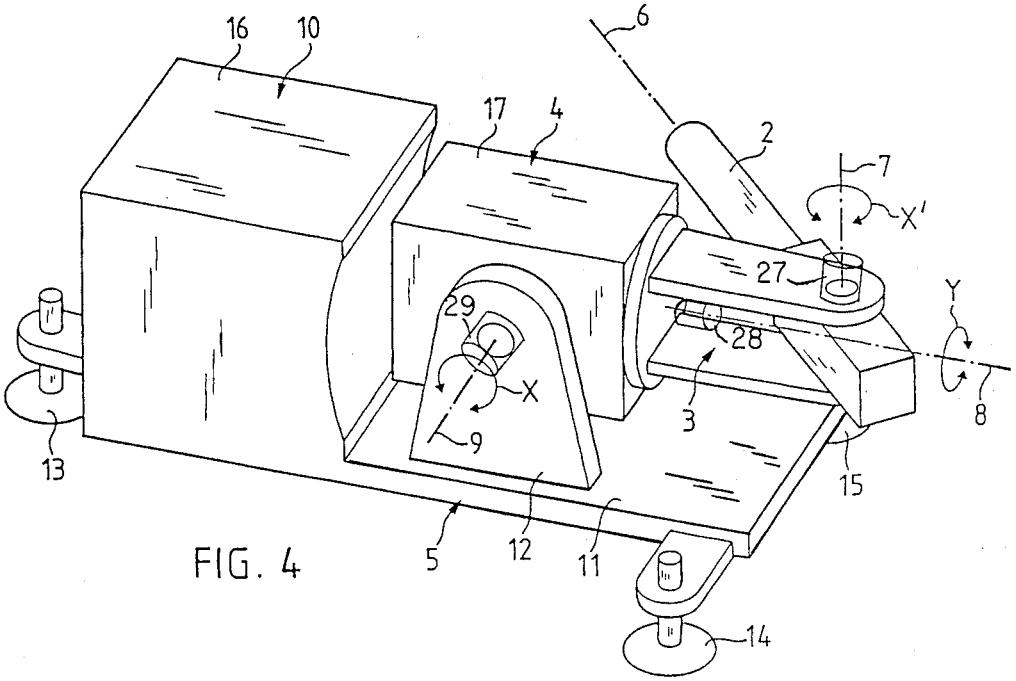

The base body 5 has for this purpose, by way of example, a stationary bearing body which is arranged beside a housing accommodating the operational installations (for example, energy supply, laying means such as radar and electronic equipment etc.). By the corresponding arrangement of the third axis of movement 9 and the distance thereof to the point of crossing (which is not necessarily also the point of intersection) of the first and second axes of movement 7 and 8, the aiming axis body 2 can be rotated beyond or across this housing 10 in order to be aligned at a target position located behind the housing 10. For an elimination of zones of ineffectiveness in the opposite direction caused by too small angles between an aiming axis 6 and the second axis of movement 8, the second axis of movement 8 can be adequately lowered about the third axis of movement 9, that is to say, as shown in FIG. 3, aimed below a horizontal line or plane containing the third axis of movement 9. For an adequate elimination of zones of ineffectiveness in the total laying range, a mobility of a second supporting body 4 through an angle of 90° or less can be thereby sufficient.

Furthermore, one can recognize from the course of movement illustrated in the FIGS. 1 to 4 that the heavier device components such as the second supporting body 4, which by way of example must accommodate an ammunition supply, has a smaller share of motion during all courses of movement as compared with the device components 3 and 2, which represent the aiming-axis system for tracking. This exactly corresponds with the conditions demanded from the dynamics of the system. Those system parts, from which efficient or rapid behavior is required, possess relatively little mass. The mass increases for those system parts which always have to move less and slower. A great deal of dynamics is demanded from the first and second axes 7 and 8 of movement but substantially less from the third axis of movement 9, which for certain combat positions must be brought only into a fixed selected position. If the third axis of movement 9 is brought into a new position, this usually does not take place during a tracking operation, but then, when a new area sector should be guarded.

The device according to the invention essentially consists of an aiming axis body 2, a first supporting body 3, the second supporting body 4 and the base body 5, which are connected with one another by the aforementioned three rotational axes or axes of movement 7 to 9, such that the third rotational axis or base axis 9 between the base body 5 and the second supporting body 4 and the second rotational axis or singularity axis 8 between the aiming axis body 2 and the first supporting body 3 are adjustable parallel to one another and are at a distance to one another within which the common center of gravity of the device or its moving parts is located.

Drive means 27, 28 and 29 are provided for alignment of the aiming axis body 2, namely first drive means 27 for rotation of the aiming axis body 2 about the first rotational axis 7, second drive means 28 for rotation of the aiming axis body 2 about the second rotational axis 8, and third drive means 29 for rotation of the second supporting body 4 about the third rotational axis 29.

In a weapon technological application of the device according to the invention, the aiming axis body 2 corresponds to a weapon (gun barrel, laser etc.), the first movable supporting body 3 with a top gun mount and the second movable supporting body 4 with a bottom gun mount.

As is generally known in connection with gun weapons for defense against flying targets, the aiming axis body 2 or the gun barrel is pivotable in the direction of the arrow X' about the first rotational axis or axis of movement or laying axis 7 extending perpendicular to the aiming axis 6 and, furthermore, pivotable in the direction of the arrow Y about the second rotational axis or axis of movement 8 extending perpendicular to the first axis of movement 7, in order to be aligned or laid at a moving target body.

In known gun weapons, the second axis of movement 8 is directed at a constant angle, by way of example, vertically or perpendicularly. The result is that the gun has a corresponding upward directed and widening zone of ineffectiveness, in which the aiming axis 6 is at a too small angle with respect to the second axis of movement 8, in order to be able to track a flying target by adequately rapid rotary motion about this second axis of movement 8.

Figure 2:
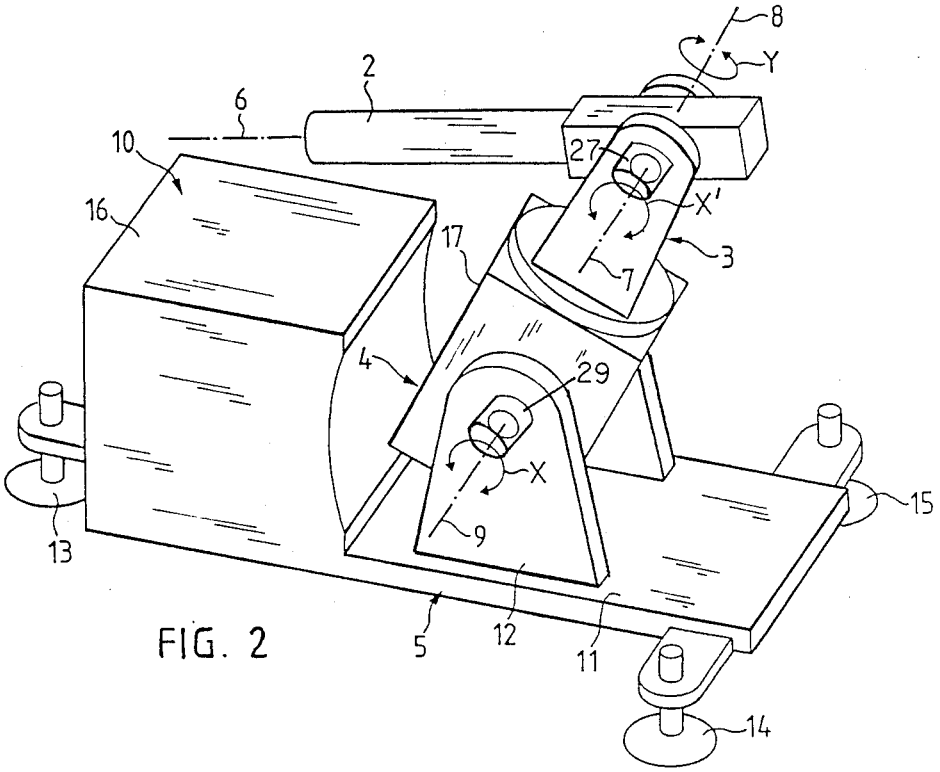

According to the aforementioned European Published Patent Application No. 72,669, the zone of ineffectiveness directed upwardly at an angle of, for example, 30° with respect to the vertical in the direction of the second axis of movement 8 can be pivoted away at a constant angle of inclination about a vertical axis on a not illustrated circular path. However, the vertically upward directed zone thus remains unchangedly close to the zone of ineffectiveness. This is prevented according to the present invention by the mounting of the second movable supporting body 4 for rotation about a stationary, horizontal third axis of movement 9, i.e., the base axis, about which the second supporting body 4 is pivotable in the direction of the arrow X. This third axis of movement 9 is arranged at a distance or spacing A to a not particularly referenced crossing point which preferably is the intersection point of the two rotational axes 7 and 8. Therefore, the inclination of the second axis of movement, also known as the singularity axis, can be continuously changed, for example, also sloping downward according to the illustration in FIG. 3, and the crossing point or the point of intersection of the two axes 7 and 8 moves upwardly and downwardly together with the aiming axis body 2 at the distance A on a not particularly shown circular path. As shown in FIG. 2, an upper position of the first axis of movement 7 and therewith the aiming axis body 2 renders possible, from this particularly favorable position for target detection and tracking, also the detection of target objects which are located behind or move past the raised housing 10 of the device.

Due to the elevated arrangement of the third axis of movement 9 in the upper zone of a bearing body 12 fixedly arranged on a base platform 11, the second axis of movement 8 can also be downwardly inclined in order to detect target objects which are close to and beneath the horizontal plane.

The construction principle according to the invention can be realized by simply designed structural elements, so that a high operational safety results. The first movable supporting body 3 and the stationary bearing body 12 are constructed, by way of example, as a forked or bearings the bodies to be mounted, i.e., the aiming axis body 2 and the second movable supporting body 4. The mounting about the third axis of movement 9, i.e., the bearing body 12, can also be integrated in the housing.

The defined alignment of the three axes of movement 7, 8 and 9 relative to one another leads to a correspondingly simple design of the operational devices provided in the housing 10 for the control of non-illustrated drives as well as for the movement of the aiming axis body 2, the first supporting body 3 and the second supporting body 4 relative to one another and relative to the base body 5. The base body 5 stands on three spindle columns or supports 13, 14 and 15 which render possible a stable support of the platform 11 of the base body 5.

It is self-evident, that the device according to the invention can serve for the easy and rapid alignment of very different devices which are to be aligned or laid at an object and thus can be designated as aiming axis bodies. For example, classed hereto are laser devices, other optical instruments, radar devices and all devices whose optical or any other axes are intended to be aligned to or aimed at a target object.

While there are shown and described present preferred embodiments of the invention, it is to be distinctly understood that the invention is not limited thereto, but may be otherwise variously embodied and practiced within the scope of the following claims.

I claim:

1. A device for aiming an aiming axis body at a target, comprising:

an aiming axis body defining an aiming axis;

a first supporting body rotatably supporting said aiming axis body for rotation about a first rotational axis constituting a laying axis and extending substantially perpendicular to said aiming axis;

first drive means for rotating said aiming axis body about said laying axis;

a second supporting body rotatably supporting said first supporting body for rotation about a second rotational axis constituting a singularity axis and extending substantially perpendicular to said first rotational axis;

second drive means for rotating said first supporting body about said singularity axis;

said laying axis and said singularity axis conjointly defining a laying axis system;

a base body;

a bearing body stationarily supported at said base body;

said bearing body defining a top zone located at a predeterminate height above said base body;

said bearing body at said top zone rotatably supporting said second support body for rotation about a third rotational axis constituting a base axis and extending at a predeterminate spacing from said first rotational axis and substantially perpendicular to said singularity axis; and third drive means for rotating said second supporting body and thereby said laying axis system defined by said laying axis and said singularity axis, at said top zone of said bearing body about said third rotational axis.

2. The device as defined in claim 1, further including:

a housing fixedly arranged adjacent said second supporting body;

said housing having a predetermined height and extending above said top zone of said bearing body; and said predeterminate spacing between said third rotational axis and said first rotational axis being greater than said predetermined height of said housing in order to permit said aiming axis body to be moved across said housing during an aiming operation.

3. The device as defined in claim 1, wherein:

said singularity axis, upon rotation of said second supporting body about said base axis under the action of said third drive means, is downwardly pivotable below a horizontal plane containing said base axis.

4. The device as defined in claim 1, wherein:

said second supporting body is rotatably movable about said base axis under the action of said third drive means through a rotational angle of at least 90°.

5. The device as defined in claim 1, further including:

support means provided at said base body for stably supporting the entire device.

* * * * *